United States Patent [19]

Long

[11] 4,067,198

[45] Jan. 10, 1978

[54] METHOD AND STRUCTURAL SUPPORT FOR INCREASING LOAD CARRYING CAPACITY IN PERMAFROST

[76] Inventor: Erwin L. Long, 5741 College Drive, Anchorage, Alaska 99504

[21] Appl. No.: 587,917

[22] Filed: June 18, 1975

[51] Int. Cl.[2] ..... E02D 3/08; E02D 5/24; E02D 27/32

[52] U.S. Cl. ..... 61/36 A; 61/53; 61/103

[58] Field of Search ..... 61/36 A, 46, 50, 53, 61/53.5, 103, 86; 165/45

[56] References Cited

U.S. PATENT DOCUMENTS

| | | | |
|---|---|---|---|
| 1,924,346 | 8/1933 | Blumenthal | 61/53 |
| 1,951,292 | 3/1934 | Cahill | 61/53 |
| 2,875,584 | 3/1959 | Turzillo | 61/50 |
| 2,909,901 | 10/1959 | Suderow | 61/53 X |
| 3,217,791 | 11/1965 | Long | 165/45 |
| 3,706,204 | 12/1972 | Long | 61/46 |

*Primary Examiner*—Casmir A. Nunberg
*Assistant Examiner*—David H. Corbin
*Attorney, Agent, or Firm*—Seed, Berry, Vernon & Baynham

[57] ABSTRACT

A modular pile unit and method of using same in which a plurality of small thermal piles are rigidly interconnected in a symmetrical array by interconnecting heat dissipation fins at the upper ends of the piles. A sleeve in one embodiment can be added to such an integral modular pile unit or, in another embodiment, can be added to an individual thermal pile to increase the effective diameter of the pile unit or the individual pile along a length extending into the permanently frozen region of the soil.

12 Claims, 5 Drawing Figures

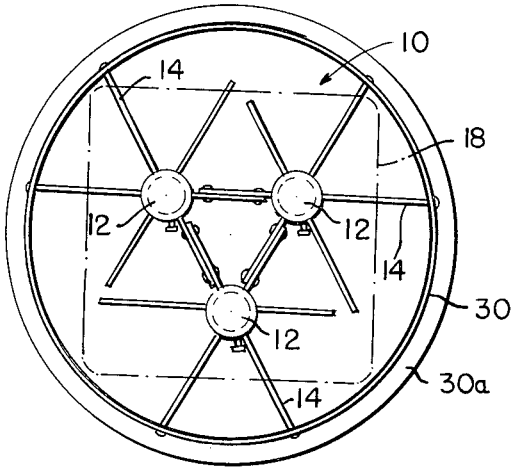
FIG. 3
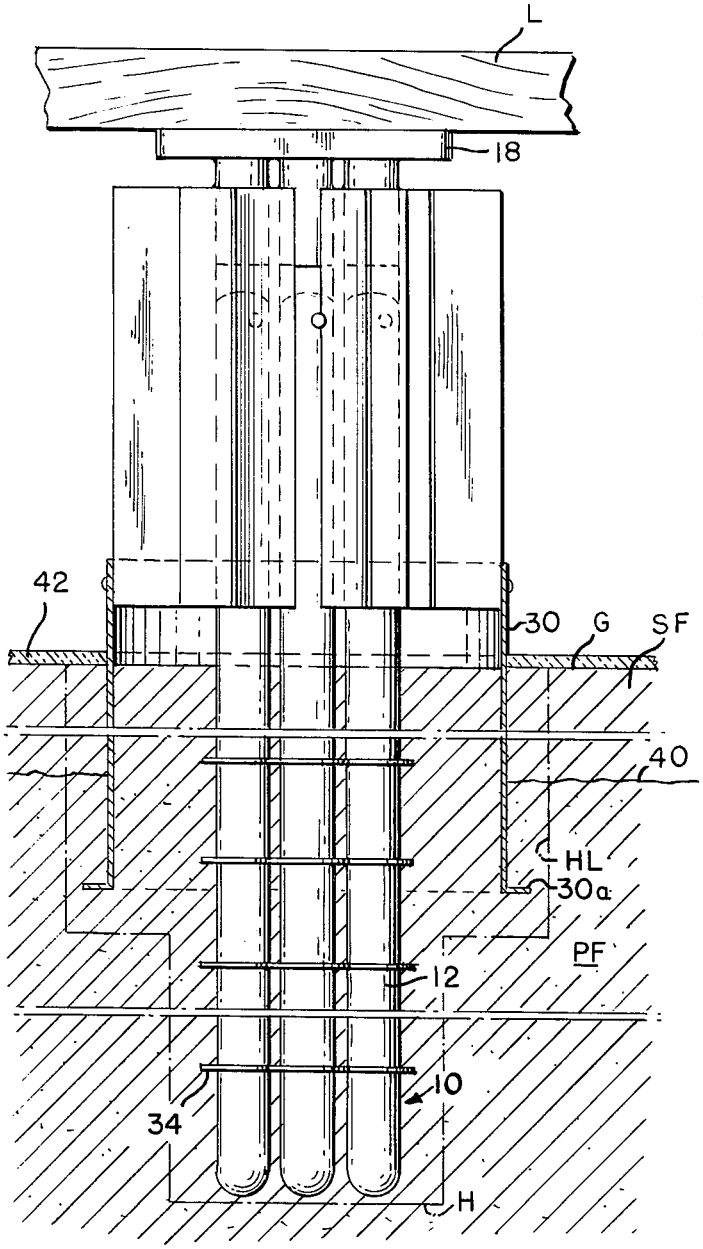
FIG. 4
FIG. 5
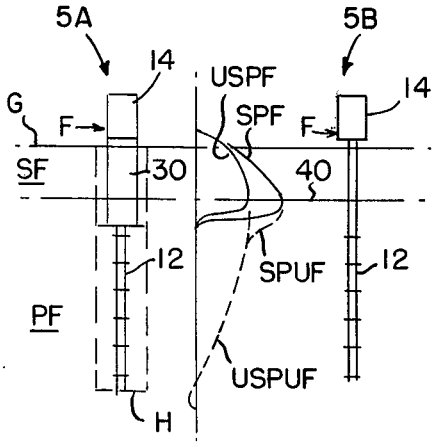

METHOD AND STRUCTURAL SUPPORT FOR INCREASING LOAD CARRYING CAPACITY IN PERMAFROST

BACKGROUND OF THE INVENTION

1. Field of the Invention

This invention pertains to methods and apparatuses for increasing the vertical and, more importantly, the lateral load-carrying capacity of a pile or pile-like supports in soil having an upper, seasonally frozen region and a lower, permanently frozen region. The invention is especially useful with refrigerating-type thermal piles which have the capability of removing heat from the permanently frozen region of the soil to increase the load-carrying capacity of the surrounding soil.

2. Description of the Prior Art

Thermal piles for use in increasing load-carrying capacity have been used heretofore. One such pile is described in my earlier U.S. Pat. No. 3,217,791. The lowering of the temperature of the permanently frozen region of permafrost soil increases the vertical and lateral load-carrying capacity of the soil surrounding the pile.

The common technique for meeting the load-carrying capacity of the piles used in a large building is to increase the size or diameter of the piles at the numerous locations around the building. It is expensive to manufacture and transport large thermal piles due to their weight and size. It is also expensive due to the fact that a thermal pile unit is essentially a pressure vessel which must be manufactured according to strict specifications. Large pressure vessels are extremely expensive. The lateral load-carrying capacity of a large-diameter pile is frequently less than is required for a pile designed to have a certain vertical load-carrying capacity. Consequently, large piles are either over-designed, with excess vertical load-carrying capacity, or cross-bracing between piles in holes spaced around the building is provided between adjacent piles to obtain the necessary lateral load-carrying capacity. Both solutions, however, are expensive.

Stepped piles, having larger diameters at their upper ends than at their lower ends, are known. A stepped pile is useful in permafrost having a lower, permanently frozen region since the larger stepped diameter can be terminated below the upper surface of the permanently frozen region and not extend the full length of the pile without substantially reducing the lateral load-carrying capacity of the pile. By stepping the pile, the remaining lower portion of the pile can be built of considerably less material, providing a substantial cost savings. The reason for this characteristic of a stepped pile in providing substantially the same lateral load-carrying capacity as a continuous larger diameter pile in frozen soil is that the point of maximum inflection along the length of the pile occurs on the pile approximately at the top surface of the permanently frozen region of the soil. That is, the stress distribution for a top laterally loaded pile is at a minimum at the point of loading and increases substantially uniformly along the length of the pile until it reaches the general area of the top surface of the permanently frozen region of the soil. Below the top surface of the permanently frozen region of the soil, the stress in the pile is reduced rapidly along the length of the pile until a point is reached along the length of the pile where little or zero stress is applied to the pile. Since the lowermost part of the pile provides little lateral load-carrying capacity, the total lateral load-carrying capacity of the pile can be increased merely by increasing the portion of the pile extending upwardly from within the permanently frozen region of the soil. While stepped pile and the advantages of stepped pile for use in permafrost are thus generally known, the maximum cost benefits have never been obtained.

SUMMARY OF THE INVENTION

It is an object of this invention to provide a large integral pile unit made of small, rigidly interconnected modular piles.

It is another object of this invention to provide a method of increasing the lateral load-carrying capacity of piles by integrally, rigidly interconnecting a plurality of small modular piles in a single hole into an integral unit.

It is still another object to increase the load-carrying capacity of piles in a less expensive manner than is presently employed.

Basically, these objects are obtained by a method of combining small piles and an apparatus which employs small, rigidly interconnected modular piles, preferably self-refrigerating or thermal piles, for use in a soil having a permanently frozen region. In the preferred embodiments, the rigid interconnection is provided on the thermal pile with the same standard fins used in the thermal pile for increasing the heat dissipating capacity of the pile. The lateral load-carrying capacity of such an integral pile unit greatly exceeds the sum of the lateral load-carrying capacities of each of the modular piles forming the unit. An advantage of such a pile unit is that small modular piles can be readily mass-produced, stored and shipped at substantially less cost than large piles. The small thermal piles are able to meet various government safety regulations for shipment of pressure vessels whereas a single large pile possibly could not. Furthermore, it is a much less expensive operation to form a large pile unit out of two or more small piles from a large inventory of small piles to meet the various load-carrying capacities necessary at different construction sites than to store an inventory of large piles of various sizes.

It is another object of this invention to provide an effective large-diameter but inexpensive stepped pile.

It is still another object of the invention to provide a pile unit formed from a plurality of modular piles, which pile unit also can be modified to form an inexpensive stepped pile unit.

It is still another object of this invention to provide a method of increasing the lateral load-carrying capacity of a single thermal pile or a multiple-pile, thermal pile unit in an inexpensive manner.

Basically, these objects are obtained by providing a sleeve radially spaced from the pile body and encircling the pile body to a depth into the permanently frozen region below the point of maximum inflection of the pile. Fill material is then added around the pile within the hole and between the sleeve and the pile body. The soil within and around the sleeve in the permanently frozen region of the soil will rigidify to form an effective, large-diameter, stepped upper end on the pile, with the fill in the seasonally frozen region also providing substantial lateral load-carrying capacity. If a plurality of modular piles are combined to form an integral pile unit, the sleeve will preferably encircle all of the piles in the unit in the hole, but less than all can be encircled, if desired. The use of a sleeve effectively increases the lateral load-carrying capacity of the pile and/or modular pile unit and also provides for a reduction in frost-jacking on the pile or pile unit. Fabrication of the sleeve can occur at the placement site, thus reducing shipping costs which would have been incurred if a stepped diameter pile had been employed.

BRIEF DESCRIPTION OF THE FIGURES OF THE DRAWING

FIG. 3 is a plan of a modular thermal pile unit employing a sleeve according to the principles of the invention.

FIG. 4 is a side elevation of the thermal pile unit shown in FIG. 3.

FIG. 5 is a schematic diagram illustrating the stress in soil surrounding a pile, with FIG. 5A illustrating a single pile having a sleeve according to the principles of the invention and FIG. 5B illustrating a conventional thermal pile without the sleeve of this invention.

DETAILED DESCRIPTION OF THE PREFERRED EMBODIMENTS

Figure 1:
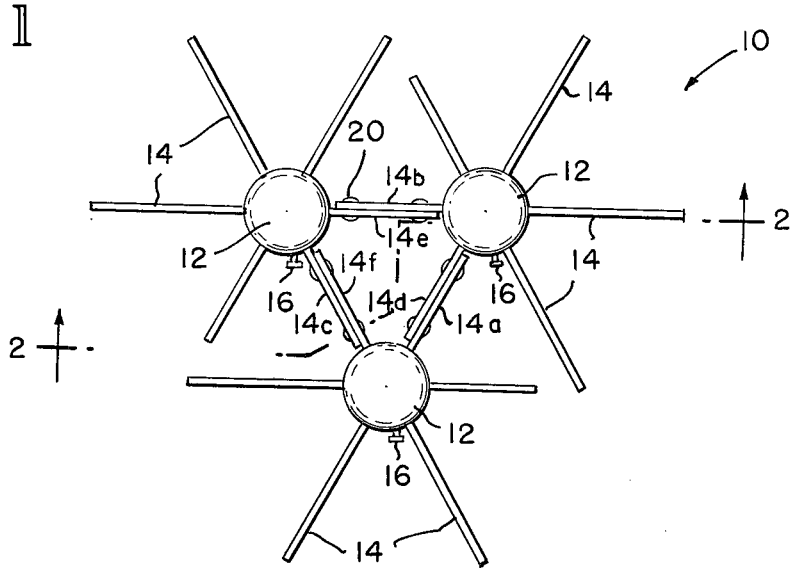
FIG. 1 is a schematic plan of a modular thermal pile unit embodying the principles of the invention.
Figure 2:
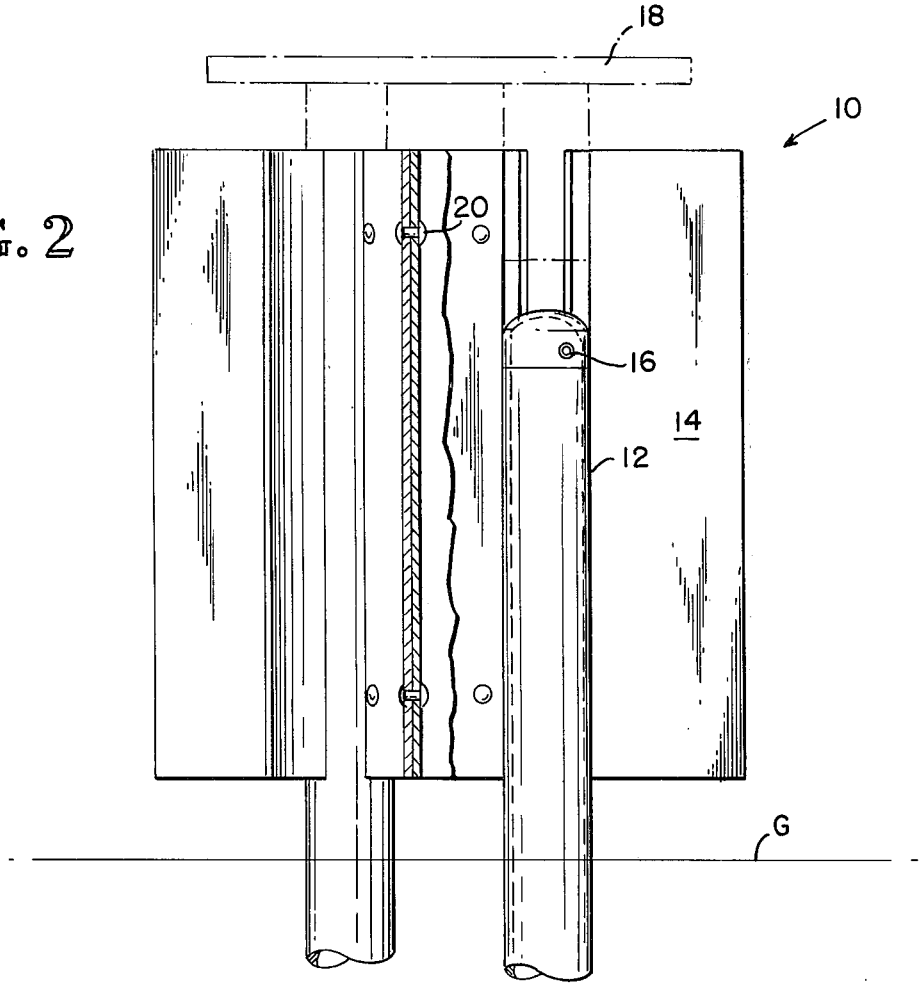
FIG. 2 is a fragmentary vertical section taken along the line 2—2 of FIG. 1.

As best shown in FIGS. 1 and 2, a preferred modular thermal pile unit 10 includes a plurality of identical, individual thermal piles 12. Preferably, each pile is generally of the type illustrated in U.S. Pat. No. 3,217,791, although the principles of the invention are applicable also to other types of thermal piles and to conventional non-refrigerating-type piles. The advantages of the invention, however, are best utilized on thermal piles which are provided with a plurality of standardized heat radiating fins 14. It is a unique feature of this invention, for example, that these fins can also be employed structurally to convert individual piles into a modular thermal pile unit 10.

The individual pile is essentially a pressure vessel having a valve 16 at its upper end for regulating the quantity of refrigerant in the pile.

The fins 14 are connected to the upper end of the pile, as by welding. A load platform 18 is fixed to a collar or collars 19 that are preferably welded to the upper ends of the fins. The collars can be welded in place after the piles are installed in the ground so that the plate 18 is horizontal and at the desired elevation. Alternatively, long collars can be welded to the fins during manufacture and then cut to desired lengths and the plate 18 added after the piles are installed.

Adjacent overlapping standard fins **14*a*–14*f* are secured together, as by bolts, welding or rivets 20. Although three piles 12 have been shown forming the modular unit in FIG. 1, it should be understood that two or numbers greater than three can be brought together into integral units in various configurations in a single hole to still obtain the benefits of the invention. Furthermore, the spacing between the piles can be increased to increase the lateral load-carrying capacity of the modular pile unit and the standardized fins still used for structural interconnection merely by reducing the amount of overlap between fins. The fins terminate generally above the ground level G, with the piles extending down into the permafrost, as is well understood. As is readily apparent, the interconnection of the adjacent fins rigidly, structurally interconnects the piles, forming an integral unit 10** which is capable of carrying lateral loads greatly exceeding the sum of the individual lateral load-carrying capacities of the individual piles. While the fins advantageously provide the means for interconnecting the piles, interconnecting structural members may be provided independent of or as a substitute for the fins. Furthermore, while longitudinal fins are illustrated, horizontal fins may also advantageously be employed, particularly in high wind velocity areas.

As best seen in FIGS. 3–5, the thermal pile unit 10 is shown with a unique sleeve 30 encircling the fins 14, being integrally secured thereto, and having a flange **30*a* which can extend inwardly or outwardly, as shown, or both. While the sleeve is illustrated as encircling the terminal ends of the fins, it should be understood that the sleeve can be joined to the bottoms of the fins at a diameter inwardly from the terminal ends of the fins so as to reduce the diameter of the hole bored in the soil to accommodate the sleeve. Alternatively, the sleeve can be slotted or the fins notched to allow placement of the sleeve inwardly of the perimeter of the fins. The size of the sleeve will be determined by the load-carrying capabilities or structural requirements desired and the characteristics of the soil in which the pile is to be used. In addition, although the sleeve is shown on a modular pile unit in FIGS. 3 and 4, it should be understood that it is equally suitable for use with a single pile 12, as shown in FIG. 5A. Since the principles of operation and structure are essentially identical for a sleeved modular pile unit as for a sleeved single pile, for purposes of brevity a detailed drawing (other than FIG. 5A**) and description are not provided. Still further, although the sleeve is advantageously shown as connected to fins of a thermal pile, the sleeve may also be joined to the pile by struts or other braces rather than the fins, provided that this alternative bracing allows the addition of fill between the pile and the sleeve.

As best shown in FIG. 4, the sleeved pile unit also includes the platforms or plates 18 to carry the load L. If desired, radial, horizontal segments, rings or flexible blades 34 are added to the pile to increase its vertical load-carrying capacity, as described in more detail in U.S. Pat. Nos. 3,706,204 and 3,797,257. The area between the piles of the pile unit 10 and between the individual piles 12 and the inside surface of the sleeve is filled with soil, gravel or any other suitable fill material normally used to fill the hole H in the soil. As is understood, the soil is of the type having a seasonally frozen region SF and a permanently frozen region PF, common in permafrost or frozen soil areas in arctic regions. A general transition area is defined by a line 40 which varies in depth, of course, according to the seasons of the year and environmental temperature above the ground, but for the purpose of this description, will be called the top of the permafrost region. Preferably, a layer of insulation 42 is laid on the ground level to reduce heating of the semi-frozen region during the warmer periods of the year.

As is well understood, the individual sleeved pile or multiple-pile, sleeved pile unit will be assembled preferably at the job site where the hole H has been prebored. The hole may have a larger diameter HL at the top which is of sufficient diameter to accommodate the sleeve 30; however, a uniform diameter hole can be used. The pile unit will then be inserted into the hole and the fill added within and without the sleeve to integrally connect the fill with the permafrost soil. As is readily apparent, the solidification of the fill within the sleeve effectively makes a solid body between the pile and the sleeve, with the flange 30*a* providing a positive interlock into the frozen soil surrounding the sleeve. The effective diameter of the upper end of the pile is thus increased to that of the sleeve.

FIG. 5 diagramatically illustrates a comparison between an unstepped pile (FIG. 5B) and a single stepped pile using the sleeve of this invention (FIG. 5A), their approximate generalized stress diagrams both receiving the same lateral force applied at the arrow F. Curves are illustrated to represent an unstepped pile/frozen soil (USPF), an unstepped pile/unfrozen soil (USPUF), a stepped pile/frozen soil (SPF), and a stepped pile/unfrozen soil (SPUF). As is readily apparent, curve USPUF, for an unstepped pile/unfrozen soil, starts at a minimum stress at the point of application of the force F and increases through about one-half the length of the pile, then decreases until it reaches a point near the bottom of the pile, again reaching zero stress. A generalized curve USPF for the same unstepped pile in frozen soil shows a curve which also increases from zero at the point of the application of the force F, increasing to a maximum at the point of inflection 40 and then drastically falling off to zero shortly below the top surface of the permanently frozen region. Thus, the pile, in permanently frozen soil, carries very little lateral load in its lower length.

Curve SPUF shows the advantage gained by using a stepped pile in unfrozen soil. That is, the curve is shifted to the right or to the direction of increasing stress-carrying capacity in FIG. 5. Like the curve USPUF, however, the stress distribution occurs along substantially the entire length of the pile, generally following curve USPUF at the lower end. Curve SPF illustrates the increased lateral load-carrying capacity for the stepped pile in the frozen soil condition which allows for maximum lateral load-carrying capacity at a minimum increase in cost. For example, the larger diameter obtained from the sleeve 30 need not extend down below the line where zero stress distribution again occurs in the soil around the pile. Thus, it is readily apparent that by increasing the diameter of the pile down to and into the permanently frozen region, the total lateral load-carrying capacity of the pile is increased.

While the preferred embodiments of the invention have been illustrated and described, it should be understood that variations will be apparent to one skilled in the art without departing from the principles herein. Accordingly, the invention is not to be limited to the specific embodiments illustrated.

The embodiments of the invention in which a particular property or privilege is claimed are defined as follows:

1. A structural, modular, thermal pile unit for use in a hole in permafrost, comprising at least two hollow, cylindrical piles having external surfaces adapted to be exposed to the sidewall of the hole and each having an active heat transfer fluid therein and a plurality of radially and axially extending fins at the upper ends of each pile extending externally of the pile and adapted to be positioned at least partially above ground for increased heat dissipation to the atmosphere for cooling the heat transfer fluid, the improvement comprising means located laterally outwardly of each pile external surface rigidly joining adjacent fins of each pile to form an integral, combined, multiple-pile unit for use in a single hole as a substitution for a single larger pile in the hole and thereby increasing the lateral load-carrying capacity of the area around the hole as well as providing additional vertical load-carrying capacity area surrounding the hole and increased below ground cooling capacity over that of the single large pile for which the unit is a substitute.

2. The pile unit of claim 1, including at least three piles, each having adjacent fins rigidly secured together in a symmetrical array whereby the combined lateral load-carrying capacity of the pile unit greatly exceeds the sum of the lateral load-carrying capacities of each pile.

3. The pile unit of claim 1, said fins extending above each pile and having collars joined to their inner opposed surfaces, said pile unit including a load-supporting plate joined to said collars.

4. The pile unit of claim 1, including an elongated sleeve secured to said fins, extending longitudinally along said pile unit, spaced outwardly of the individual piles and adapted to be inserted into the permanently frozen region of the surrounding soil for providing increased lateral support capacity to the pile unit which greatly exceeds the lateral support capacity of the sum of the piles.

5. The pile unit of claim 3, including an elongated sleeve secured to said fins, extending longitudinally along said pile unit, spaced outwardly of the individual piles and adapted to be inserted into the permanently frozen region of the surrounding soil for providing increased lateral support capacity to the pile unit which greatly exceeds the lateral support capacity of the sum of the piles.

6. A method of increasing the lateral load-carrying capacity of an elongated pile in a soil having a seasonally frozen upper region and a permanently frozen lower region, comprising:

forming a hole, with at least an upper end of a diameter substantially larger than the pile diameter, in the soil through the seasonally frozen region and into the permanently frozen region, adding an elongated sleeve around only an upper end of the pile so that the sleeve terminates substantially short of the lower end of the pile and is laterally spaced therefrom, rigidly interconnecting the pile and sleeve, lowering the pile and sleeve into the hole until the lower end of the sleeve extends into the permanently frozen region, and filling the hole around the pile and sleeve and between the pile and sleeve to form a fill layer trapped between the sleeve and the pile, and freezing the trapped fill layer to effectively radially extend the diameter of the pile to the diameter of the sleeve to a line below the upper surface of the permanently frozen region.

7. The method of claim 6, including the step of cooling the soil around the lower end of the pile to reduce the temperature of the permanently frozen region.

8. The method of claim 6, including structurally, rigidly interconnecting a plurality of piles to form an integral pile unit, providing said elongated sleeve around said integral pile unit and terminating the sleeve short of the end of any of the piles, rigidly interconnecting said sleeve to said pile unit, forming at least the upper end of the hole to a diameter greater than the diameter of said pile unit plurality of piles, lowering the pile unit into the hole with the sleeve terminating within the permanently frozen region, and filling the hole around and between said piles or said pile unit and between said sleeve and said pile unit to increase the effective diameter of said pile unit.

9. The method of claim 8, including the step of cooling the lower end of the pile unit to lower the temperature of the permanently frozen region and rigidify the trapped fill.

10. The method of claim 6, wherein the step of forming the hole includes forming the hole of substantially larger diameter only into the permanently frozen region and forming the remainder of the hole to accommodate the lower end of the pile to a smaller diameter.

11. The method of increasing the load-carrying capacity of the soil around a pile in a soil having an upper, seasonally frozen region and a lower, permanently frozen region, comprising:

forming an integral pile unit of a plurality of smaller piles each normally having an external surface adapted to be exposed to the sidewall of a hole in the soil by rigidly interconnecting the piles outwardly of said external surfaces in a spaced, symmetrical array, forming a hole extending into the permanently frozen region of the soil, placing the pile unit into the hole extending into the permanently frozen region with the external surfaces of the piles facing the sidewall of the hole, and filling the hole around and between the piles of the pile unit.

12. The method of claim 11, including cooling the lower end of the pile unit to lower the temperature of the permanently frozen region.

* * * * *